US005873451A

United States Patent [19]

Backman

[11] Patent Number: 5,873,451

[45] Date of Patent: Feb. 23, 1999

[54] BUFFERING METHOD AND BUFFERING SYSTEM FOR NEWSPAPER PRODUCTION

[75] Inventor: Ralf Backman, Eksjö, Sweden

[73] Assignee: Idab Wamac AB, Eksjö , Sweden

[21] Appl. No.: 623,551

[22] Filed: Mar. 28, 1996

[30] Foreign Application Priority Data

May 4, 1995 [SE] Sweden ..... 9501258

[51] Int. Cl.[6] ..... B65G 47/26

[52] U.S. Cl. ..... 198/418.6; 198/418.7

[58] Field of Search ..... 198/644, 418.5, 198/418.6, 418.7, 418.9, 419.2, 460.3, 462.2, 426, 431

[56] References Cited

U.S. PATENT DOCUMENTS

| | | | |
|---|---|---|---|
| 3,877,563 | 4/1975 | Hayashi | 198/418.6 |
| 4,471,953 | 9/1984 | Reist et al. | 198/644 X |
| 5,366,064 | 11/1994 | Gamberini et al. | 198/418.7 X |

*Primary Examiner*—James R. Bidwell
*Attorney, Agent, or Firm*—Evenson, McKeown, Edwards & Lenahan, PLLC

[57] ABSTRACT

A buffering method and system used in newspaper production employed between a printing press and a production room. The buffering system and method ensures a proper flow of newspapers from the printing press to the production room.

8 Claims, 1 Drawing Sheet

BUFFERING METHOD AND BUFFERING SYSTEM FOR NEWSPAPER PRODUCTION

Figure 1:
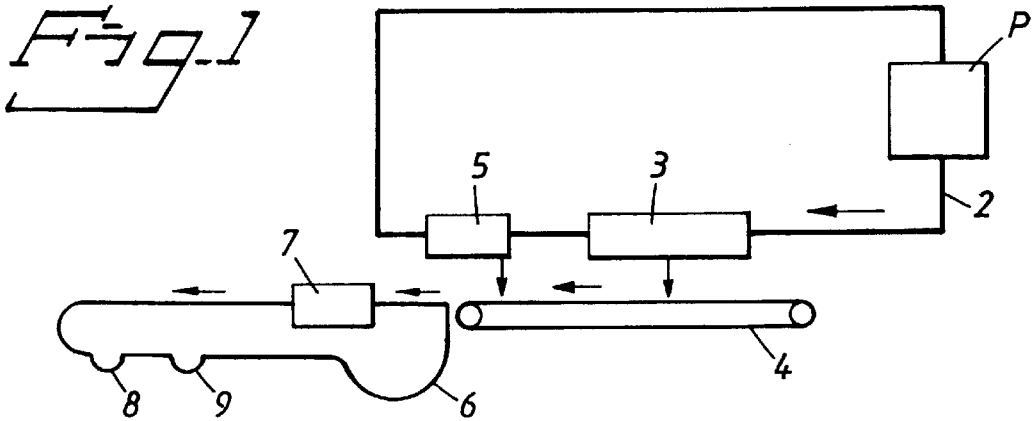

The invention relates to a buffering method of delivering, from a stream of newspapers conveyed by a gripper conveyor, a smaller stream of uniformly divided newspapers to a finishing room for further treatment or processing, and to a buffering system.

The invention thus relates to the technique by which newspapers and the like are produced in a printing press and transported therefrom with the aid of a gripper conveyor at a rate of flow suitable from a printing aspect. The newspapers produced in the press are led to a finishing room, in which there prevail circumstances that are able to influence the production capacity of the finishing room other than those circumstances which determine the production rate of the press. The production capacity of the finishing room does not normally stand in any fixed proportion to the optimal production rate of the press, but constitutes a part thereof.

The varying maximum production rates in the finishing room can be said to relate to the appearance and quality of the newspaper products. For instance, a thick newspaper supplementary cannot be run as quickly as a thin supplementary, due to the high mass forces involved.

Consequently, when viewed against the fact that the production capacity of the finishing room is controlled by internal production-technical parameters, it is desirable, and necessary, to feed newspapers to the finishing room at a product flow rate which is lower than but independent of the production flow rate of the printing press.

The use of buffer systems is well known one known buffer system receives the flow of products from the press and establishes a product buffer from which buffered products are then discharged in an essentially continuous flow with a uniform division or "pitch" between the products and at a rate of flow that can be adapted to the requirements of the finishing room.

A well-known and tested buffer system is marketed by Müller-Martini and includes a plurality of reels. An overlapping stream of newspapers is wound onto a reel with the aid of a reel-on belt. When the first reel is filled, the flow of newspapers from the press are wound onto a fresh reel in a similar manner. The newspaper stream wound onto the first reel can then be unreeled at a desired rate and fed to the finishing room for further treatment and processing. One drawback with this known buffer system is that when the press is started-up, the newspapers delivered from the press must first be reeled-up in suitable quantities (corresponding to a press production time of 10–15 minutes) in the reeling system. It is not until this has been done that reels can be changed and that the first newspapers produced can be unreeled and passed to the finishing room. In practice, this means that production in the finishing room is delayed by about fifteen minutes in relation to starting-up production in the press. Furthermore, at least a corresponding time delay is experienced each time the press is started-up with each new newspaper edition, since it is necessary to first empty the buffer system before beginning to fill the system with the new addition.

Because the whole of an edition must pass through the buffer system, the system is often required to have a relatively large capacity since it must be able to contain large numbers of newspapers.

Another drawback with the known buffer system is that the newspapers are reeled-up between strenuously stretched belts around a reel of relatively small radius, resulting in skrinkling, greasing and set-offs, primarily in the case of 4-colour print newspapers.

The object of the present invention is to provide a buffer system which avoids the aforesaid drawbacks. Thus, the object of the present invention is to provide a technique which will enable processing of the newspapers in the finishing room to be commenced immediately after starting-up the press. The object also includes the provision of a buffering technique which, in principle, enables buffering of solely that part of the press production flow which cannot be transferred directly to the finishing room, i.e. buffering/storage of solely the number of newspapers that constitute the difference in production capacity between press and finishing room. This means that only relatively small numbers of newspapers need be stored at any moment in time and that the capacity (cost) of storage equipment and storage space can be greatly reduced. In turn, this enables conveniently the use of storage equipment (for instance of the known type LSS 900 Line Storage System, Idab-Wamac AB, Box 189, Eksjö, Sweden), which will allow the newspapers to be stored in a way such that in storage the newspapers will lie unaffected in undisturbed sections of an overlap stream, and therefore retain their print quality, wherein said sections can be taken out and inserted in the same direction, i.e. through-flow storage.

The object of the invention is achieved by a buffering method of delivering, from a stream of newspapers conveyed from a printing press by means of gripper conveyor, a smaller stream of uniformly divided newspapers to a finishing room for further treatment or processing. A system is also provided.

A fundamental feature of the inventive method is that the gripper conveyor which typically grips individual newspapers leaving the press passes a lay-off station where a plurality of gripper opening mechanisms simultaneously actuate a corresponding series of mutually sequential grippers so as to cause a batch comprising a corresponding number of newspapers to be deposited onto a second conveyor, normally a belt conveyor in the station. A selected number of products on the gripper conveyor, between the newspaper batches that have been laid off, are conveyed through the station to a buffer magazine by the gripper transporter. The other conveyor is driven at a speed which causes the newspaper batches to be mutually joined on the other conveyor to form a product series of constant division or overlap between the newspapers.

It will be understood that the proportion between the gripper opening mechanisms actuated simultaneously in the station on the one hand and the sum of the number of gripper opening mechanisms and the number of products that are conveyed further to the buffer magazine on the other hand will define the percentage of the production flow of the press that is passed to the other conveyor. The person skilled in this art is therefore able to select the number of gripper opening mechanisms in the station and also to chose the number of products that shall be conveyed further through the station, so as to establish a suitable control interval for that part of the press production flow which is to be passed to the other conveyor.

The buffer magazine is emptied onto the other conveyor after the press is shut down, therewith enabling the press to be reset for a new edition as the buffer magazine is being emptied.

The gripper transporter can therefore begin to feed newspapers to the other conveyor immediately after starting-up the press, providing, of course, that there has been sufficient time to empty the buffer magazine.

The production capacity of the finishing room is often determined by the highest possible production rate of an inserter operating in the finishing room. By way of example, the production flow of an inserter may lie in the region of 0.9–0.5 times the production flow of the press, which may be 45,000 copies per hour, for instance.

Figure 2:
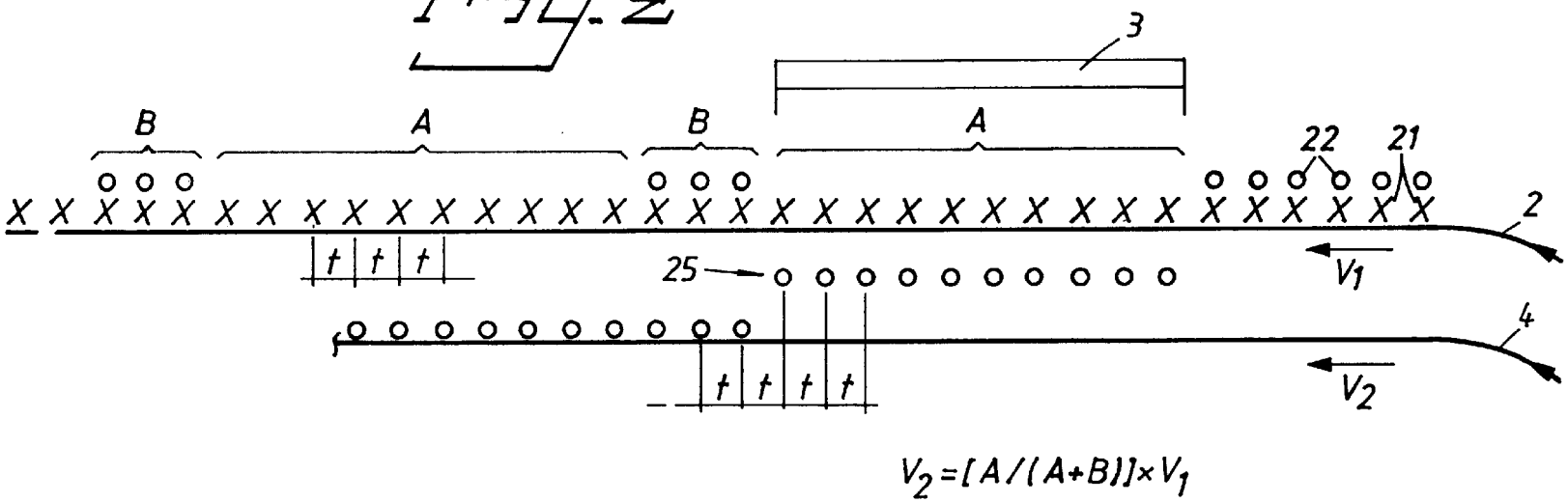

The invention will now be described in more detail with reference to exemplifying embodiments thereof and also with reference to the accompanying drawing, in which FIG. 1 is a flow sheet illustrating schematically a printing press, a gripper conveyor and its connection to another conveyor; and FIG. 2 illustrates schematically transfer means for transferring a selected portion of the products carried by the gripper conveyor to another conveyor while forming a product stream with uniform division or overlap of the products on said other conveyor.

FIG. 1 illustrates schematically a printing press P from which a gripper conveyor/edged conveyor 2 conveys newspapers to a laying-off device 3 where a selected proportion of the newspapers leaving the press are transferred to another conveyor 4. The remaining newspapers leaving the press are stored in a buffer magazine 5, from which they can be transferred to the other conveyor 4. The other conveyor 4 may be a conventional belt conveyor provided with vacuum means for stabilizing the overlap stream of newspapers on the conveyor 4. The conveyor 4 may, in turn, feed a gripper conveyor 6 which passes an inserter 7 which functions to insert supplements into the newspapers leaving the press P. The newspapers compiled in the inserter 7 can then be laid-off in one or more lay-off stations 8, 9 for further treatment.

An essential feature of the invention is that the buffer arrangement proposed in accordance with the invention need only store those newspapers which are not transferred directly to the other conveyor; in this respect, the buffer 5 can be considered as an overflow buffer.

In order to enable the newspapers leaving the press P and laid-off in the laying-off station 3 to be further processed or treated, it is normally necessary for the laid-off newspapers to form a newspaper stream with a constant division or overlap therebetween.

According to another important aspect of the invention, the laying-off station 3 is, in principle, constructed in the way illustrated in FIG. 2.

FIG. 2 illustrates the gripper conveyor 2 with the grippers 21 thereof marked with a cross. Newspapers 22 are marked with circles. A belt conveyor 4 extends parallel with the gripper conveyor 2 along a section thereof. The belt conveyor 4 may be of a conventional kind and is provided with vacuum means for holding the laid-off newspapers in an overlapping formation with the aid of a subpressure.

The actual laying-off station 3 includes an array of known gripper opening mechanisms. These gripper opening mechanisms may each include a ramp which can be inserted temporarily into the path of the grippers 21, such that a manoeuvering arm on the gripper 21 will be swung up by the switching effect caused by the ramp and therewith release the newspaper held in said gripper, wherewith the newspaper falls down onto the conveyor 4. The grippers 21 are normally spaced 10 cm apart, for instance.

The laying-off station 3 includes an array comprising a chosen number A of gripper opening mechanisms, in the illustrated case ten mechanisms, which are arranged to be activated simultaneously so that a batch 25 of newspapers will be deposited simultaneously in overlapping formation on the co-travelling conveyor 4. In the illustrated example, the gripper opening mechanisms are ten in number and are activated at a frequency which corresponds to the passage of A+B grippers 21 (with newspapers 22), for instance thirteen grippers, beyond a fixed point along the conveyor 2. The grippers 21 have a constant spacing or pitch t on the conveyor 2. It can also be assumed that all grippers 21 grip a respective newspaper 22 at the press P.

Thus, an A-number of newspapers are laid-off in the station 3, i.e. the newspaper batch 25 dropped onto the conveyor 4, whereafter the following B-number of newspapers on the conveyor 2 pass through the station 3 before the gripper opening mechanisms therein are re-activated. By allowing the conveyor 4 to move at a speed which is adapted to the relationship between the number of grippers that are opened in the station 3 and the number of newspapers that are allowed to pass through the station 3, the batches of newspapers 25 deposited on the conveyor 4 will overlap one another such that the division between the newspapers will be the same both in the batch joins and within the batches themselves.

When the speed of the gripper conveyor 2 is $V_1$ and the speed of the belt conveyor 4 is $V_2$, then $V_2$ will equal $[A/(A+B)]V_1$ if the newspapers shall have an equal division in a continuous stream on the conveyor 4.

In this way, it is possible to establish a newspaper flow of uniform division for further treatment or processing in the finishing room directly from the newspaper flow leaving the press P, with the aid of simple means and within wide limits.

EXAMPLE

The press has a newspaper flow rate of 45,000 copies per hour=$V_1$.
A=10

| Desired newspaper flow rate $V_2$ to finishing room | Number of newspaper copies B that pass through station 3 |
|---|---|
| 45,000 copies/hr. | 0 copy |
| 40,909 copies/hr. | 1 copy |
| 37,500 copies/hr. | 2 copies |
| 34,655 copies/hr. | 3 copies |
| 32,142 copies/hr. | 4 copies |
| 30,000 copies/hr. | 5 copies |
| 28,125 copies/hr. | 6 copies |
| 26,470 copies/hr. | 7 copies |
| 25,000 copies/hr. | 8 copies |
| 23,684 copies/hr. | 9 copies |
| 22,500 copies/hr. | 10 copies |

It will be understood that the laying-off station 3 may include a different number A of gripper opening mechanisms than that described, and that another number B of newspapers may be chosen to pass through the station 3 to the buffer store, so as to enable a suitable flow rate $V_2$ to be chosen and effected with the aid of suitable steps and within a suitable interval.

I claim:

1. A method of delivering, from a stream of newspapers ($V_1$), conveyed from a printing press by means of a gripper conveyor, a smaller stream of uniformly divided newspapers to a finishing room for further treatment or processing, wherein newspapers are buffered, comprising the steps of:

laying-off onto another conveyor in a laying-off station mutually equal newspaper batches each comprising a plurality of newspapers (A) which follow one another sequentially in series with uniform division therebetween;

passing a selected number of newspapers (B) by means of the gripper conveyor to a buffer magazine for buffer storage of the selected number of newspapers; and driving the another conveyor at a speed ($V_2=V_1(A/A+B)$) at which the batches will be brought into mutually overlapping or spliced relationship on the another conveyor so as to obtain a newspaper series of constant division.

2. A method according to claim 1, further comprising emptying the buffer magazine onto the another conveyor after switching-off the printing press.

3. A method according to claim 1, further comprising causing the gripper conveyor to deliver to the another conveyor immediately after starting-up the press a product flow ($V_2$) which is established by appropriate selection of the number (A) of newspapers in the batch and the number (B) of newspapers that pass through the station to the magazine.

4. A buffering system for establishing from a stream of newspapers ($V_1$) leaving a printing press a smaller stream of uniformly divided newspapers and delivering the smaller stream to a finishing room for further treatment or further processing, wherein a gripper conveyor is used for conveying the newspapers from the printing press, and wherein newspapers are buffered in a buffer magazine comprising:

a laying-off station as part of the gripper conveyor, the laying-off station having a plurality (A) of simultaneously actuable gripper opening mechanisms which function to deposit onto another conveyor a newspaper batch comprising the smaller stream of newspapers (A);

wherein the another conveyor runs generally parallel with and in the same direction as the gripper conveyor;

wherein the gripper conveyor functions to convey a selected number (B) of newspapers on the gripper conveyor between opened grippers of the gripper conveyor through the laying-off station and to the buffer magazine;

and wherein the another conveyor has drive means which moves the another conveyor at a speed ($V_2=A/(A+B)$ $V_1$) which is adapted to a speed ($V_1$) of the gripper conveyor and to the number of newspapers in the batch and the number (B) of newspapers conveyed to the buffer magazine so that the batches will be disposed on the another conveyor in a newspaper series of constant division.

5. A system according to claim 4, further comprising means for emptying the buffer magazine onto the another conveyor after switching-off the press.

6. A system according to claim 4, wherein the gripper conveyor is arranged to convey newspapers from the press to the another conveyor for processing or treating the newspapers in the finishing room immediately after starting-up the press.

7. A method according to claim 2, further comprising causing the gripper conveyor to deliver to the second conveyor immediately after starting-up the press a product flow ($V_2$) which is established by appropriate selection of the number (A) of newspapers in the batch and the number (B) of newspapers that pass through the station to the magazine.

8. A system according to claim 5, wherein the gripper conveyor is arranged to convey newspapers from the press to the other conveyor for processing or treating the newspapers in the finishing room immediately after starting-up the press.

* * * * *